US005322377A

United States Patent [19]

Asai

[11] Patent Number: 5,322,377

[45] Date of Patent: Jun. 21, 1994

[54] PRINTING DEVICE HAVING A FLOATING PLATEN

[75] Inventor: Naoki Asai, Suwa, Japan

[73] Assignee: Seiko Epson Corporation, Tokyo, Japan

[21] Appl. No.: 931,462

[22] Filed: Aug. 7, 1992

[30] Foreign Application Priority Data

Aug. 7, 1991 [JP] Japan ..... 3-197951

[51] Int. Cl.[5] ..... B41J 11/20

[52] U.S. Cl. ..... 400/55; 400/58; 400/649

[58] Field of Search ..... 400/59, 60, 55, 56, 400/57, 58, 648, 649, 655

[56] References Cited

U.S. PATENT DOCUMENTS

| | | | |
|---|---|---|---|
| 4,098,389 | 7/1978 | Kwan | 400/58 |
| 4,303,013 | 12/1981 | Shimodaira | 400/694 |
| 4,365,900 | 12/1982 | Gottsman et al. | 400/58 |
| 4,525,085 | 6/1985 | Akazawa | 400/59 |
| 4,652,153 | 3/1987 | Kotsuzumi et al. | 400/56 |
| 4,676,675 | 6/1987 | Suzuki et al. | 400/56 |
| 4,787,759 | 11/1988 | Geis et al. | 400/55 |
| 4,917,512 | 4/1990 | Mimura et al. | 400/56 |
| 5,000,590 | 3/1991 | Einem | 400/55 |
| 5,009,526 | 4/1991 | Kirchhof | 400/56 |
| 5,017,027 | 5/1991 | Koike | 400/58 |

FOREIGN PATENT DOCUMENTS

| | | | |
|---|---|---|---|
| 391829 | 10/1990 | European Pat. Off. . | |
| 0089189 | 5/1984 | Japan | 400/58 |
| 0116485 | 6/1985 | Japan | 400/58 |

*Primary Examiner*—Edgar S. Burr
*Assistant Examiner*—John S. Hilten
*Attorney, Agent, or Firm*—Eric B. Janofsky

[57] ABSTRACT

A printing device which employs a platen frame mounted on a resin or plastic base frame with a pivoting joint and a rocker spring which biases the frames together which creates a floating platen frame. A main guide shaft is mounted on the base frame and supports a print head. A clearance member fixed to the platen frame extends toward the main guide shaft and is pressed against a clearance adjustment member attached to at least one end of the main guide shaft. The clearance adjustment member allows adjustment of the platen gap while the clearance member and bias spring automatically adjust the paten gap under various printing conditions. Using this gap fixing device, the platen gap can be maintained constant even if the frame expands due to heat, thus facilitating the use of resin frames. At the same time, by using a floating platen frame and positioning a feed motor and other components on the platen frame, noise and vibrations are decreased.

25 Claims, 6 Drawing Sheets

PRINTING DEVICE HAVING A FLOATING PLATEN

BACKGROUND OF THE INVENTION

1. Field of the Invention

The present invention relates generally to printing devices used in conjunction with computerized apparatus such as word processors, data processing equipment, computer terminals, etc., and more particularly to a frame and support structure used in the construction of electronic printers. The invention further relates to a plastic, resin, or thin metal type of frame structure for use in electronic printers and a technique for controlling printer platen gap spacing.

2. Related Technological Art

A side view of a printer frame commonly used in the art is illustrated for comparison purposes in FIG. 7. An exemplary frame structure is shown in FIG. 7 specifically for a printing section of a computer controlled printer. Such a printing section, as illustrated, generally uses a main guide shaft 2 mounted on a base frame 1 and positioned to extend across, or between opposite sides of, the frame, which guides a print head 3 during movement across the frame adjacent to an output medium. Print head 3 moves along guide shaft 2 and prints a pattern or matrix of dots in response to "character" codes or signals received from an external device, such as a host computer. A platen frame 5 is also attached to, or formed as part of, base frame 1 and is positioned parallel to main guide shaft 2 opposite print head 3 with a print ribbon 4 being disposed in-between. The ribbon forms the desired dot matrix pattern being printed by print head 3 onto paper 6 or another medium positioned on platen frame 5, in response to a force exerted by pins in print head 3.

In the printing section of a printer configured in this manner, it is important that the platen gap, or gap between print head 3 and platen frame 5, here labeled W, be maintained at a constant separation distance to preserve image density or visual definition of printed characters, etc., on paper 6, and to ensure that paper 6 feeds smoothly to prevent jamming. That is, if gap W is too wide, then the force applied by print head 3 against ribbon 4 and, thus, against paper 6 in forming dot matrix patterns will not be sufficient, resulting in poor print image quality due to character or dot "drop-out" or even non-printing. If, on the other hand, gap W is too narrow, paper 6 feeding does not occur at a constant speed, which results in irregular character or print spacing, and if even narrower, the paper is more prone to jamming, making printed characters unreadable.

To prevent these kinds of problems in prior art printers, base frame 1 is formed from metal or other rigid material, and platen frame 5 is rigidly fixed to base frame 1 so that a constant platen gap W and other positional relationships are maintained. Further, in situations where paper 6 thickness varies, an attachment end 7, through which main guide shaft 2 is attached to base frame 1, is generally made eccentric with respect to main guide shaft 2. The eccentricity of attachment end 7 with respect to shaft 2, allows the relative position of print head 3, as it moves along guide shaft 2, in the base frame with respect to the platen to be adjusted by angular rotation of main guide shaft 2 and, as a result, gap W is also adjusted.

However, in recent years, computer related or electronic printers have found widespread use in offices and other locations in close proximity to equipment users and other people. The relative close proximity of these printers to people makes it necessary to take measures to prevent or at least greatly decrease noise and vibration otherwise produced by the regular use of such printers. In addition, there is an increasing demand among printer manufacturers for frames that can take on a variety of shapes to improve printer compactness and to allow easier incorporation into various electronic devices and housings. While the use of vibration and sound prevention devices with printers, such as sound absorbing covers and cabinets, has been considered as one response to these demands, the use of less noisy materials for frame construction, such as plastics or resins, has also been proposed.

Unfortunately, for resin based frames, the coefficient of thermal expansion for the resin is an order of magnitude greater than that of metal, etc., with respect to linear expansion. That is, when the temperature within the printer increases due to heat generated by the drive motor and other heat generating components mounted inside the printer, the platen gap varies due to a difference between the dimensions of thermal expansion of the base frame and any metal guide elements. The coefficient of thermal expansion for a material such as steel is on the order of 0.00118 cm/°C. while that of polyacetal is 0.01 cm/°C. and conventional engineering plastic is 0.003 to 0.008 cm/°C.

When the platen gap varies as described above, it becomes impossible to obtain clear consistent print quality, and in some cases any printing at all. Furthermore, in resin material type frames which are formed by extrusion molding, slight deformations are impossible to avoid, and if these deformations are not corrected, high quality printing cannot be achieved. Therefore, even though it is clear that many advantages could be realized by using a resin or plastic type printer frame, such frames could not previously be actually used to achieve high quality printing because of the overriding disadvantages they presented.

Another aspect of noise control, relates to the use of thinner metallic materials for constructing printer frames in order to provide more flexible or compact, and less expensive, printer designs. Unfortunately, thinner metallic materials lack sufficient rigidity and create additional noise and vibration problems, especially when used for platen portions of the printer frame. Current printer designs cannot use thinner metal parts or materials for the platen support structure without increasing the noise generated by the printer.

Therefore, a new frame design is needed that can utilize plastic or resinous materials while maintaining a constant platen gap. A new technique is also desired that would bring similar improvements in acoustical or vibration dampening when using thinner metal frames.

SUMMARY OF THE INVENTION

In order to solve the above and additional problems found in the art, one purpose of the present invention is to provide a printing device frame capable of being manufactured using resin materials.

An advantage of the present invention is that it maintains a constant platen gap under various operating conditions.

Another purpose of the invention is to decrease vibration and noise in the platen support structure even for metallic based frames.

Another advantage of the present invention is that it decreases noise and vibration while generally improving the cost efficiency of printer manufacturing.

These and other purposes, objects, and advantages are realized in a printing device comprising at least a base frame preferably made from a plastic or resinous material that has a large coefficient of thermal expansion or deformation. A main, substantially rigid, guide shaft is attached to the base frame and used to guide a print head laterally across the frame in close proximity to a platen on a platen frame that is attached to the base frame using a floating joint. The platen frame is attached so that the platen is positioned essentially parallel to the main guide shaft. Paper or another output medium is guided by the platen while the head is then moved along the shaft adjacent to the medium and printing performed. A platen gap fixing or clearance device is connected between the base and platen frames and is used to maintain a constant distance between the main guide shaft supporting the print head and the platen frame.

The platen frame is configured as a rocking, pivoting, or rotating platen frame which is attached in a lower portion through a pivot joint to the base frame so that it can be rotated in a direction perpendicular to the main guide shaft. A preferred mounting structure uses a notch in the platen frame to interface with a protrusion or pin on the base frame.

The platen frame is rotated in response to a force exerted by the gap clearance device which comprises a rigid clearance member secured to one of the two frames and an elastic member disposed between the base and platen frames. The elastic member exerts a force on the platen frame, either through compression, expansion, or otherwise, to force or rotate the platen frame toward, or away from, the main guide shaft. At the same time, the rigid clearance member regulates the gap between the main guide shaft and platen frame by resisting platen frame motion beyond predetermined limits which automatically re-adjust in accordance with thermally induced changes in dimensions.

In further aspects of the invention, the clearance member is further divided into a two part structure comprising a clearance member or element and a clearance adjustment member. The clearance member is secured on one end to either the base or platen frame, with the platen frame being preferred, and has an abutting surface extending toward the other frame, or more preferably toward the main guide shaft. The clearance adjustment member is mounted on the other, opposing, frame but in preferred embodiments on at least one end of the main guide shaft, and is coupled to the abutting surface of the clearance member.

The preferred clearance adjustment member is configured as a disk-shaped element which is mounted to rotate around an axis that is eccentric with respect to a center axis. A second, anchor, disc is typically secured to the clearance adjustment member and has a grooved or teethed surface which interacts with an anchor gear mounted adjacent to the clearance adjustment member which has a like groove or teeth pitch. The interaction of the grooved surfaces provides for accurate adjustment of the angular position of the clearance adjustment member which is turn adjusts the position of the abutting surface of the clearance member and, thus, the relative position of the platen frame and main guide shaft. A series of deeper grooves or slots can be disposed about the circumference of the anchor disc to provide a means for adjusting the angle of rotation of the disk using a flat adjustment tool such as a screwdriver. A clearance gauge can also be employed for measuring the gap between the platen frame and the print head.

Since the platen gap between the platen frame and the print head is maintained constant by using a gap fixing device to maintain a constant distance between the main guide shaft and the platen frame, clear printing images are formed even if the base frame is deformed by heat, etc. Therefore, it is possible to obtain clear printing in a printing device in which the base frame is manufactured from a resin having a large coefficient of thermal expansion. Furthermore, even if minute deformations occur in the base frame during the manufacturing or assembly processes, these deformations are corrected or compensated for by using a gap fixing device so that the platen gap remains constant.

In other aspects of the invention, a motor and feed roller assembly used for advancing the output medium or paper are mounted on the platen frame so that the effective mass of the platen frame is increased. In preferred embodiments the motor is displaced away from the main guide shaft so that its weight is leveraged around the pivoting mounting point for the platen frame. The increased effective weight or mass of the platen frame decreases noise and vibration. This is combined with the floating nature of the pivoting joint which further decreases the transmission of vibration and noise to the base frame.

Other objects and attainments together with a fuller understanding of the invention will become apparent and appreciated by referring to the following description and claims taken in conjunction with the accompanying drawings.

BRIEF DESCRIPTION OF THE DRAWINGS

The invention can be better understood from a review of the accompanying drawings which illustrate embodiments and details of the invention, in which like numbers are used to refer to like parts and in which.

DESCRIPTION OF THE PREFERRED EMBODIMENTS

Figure 1:
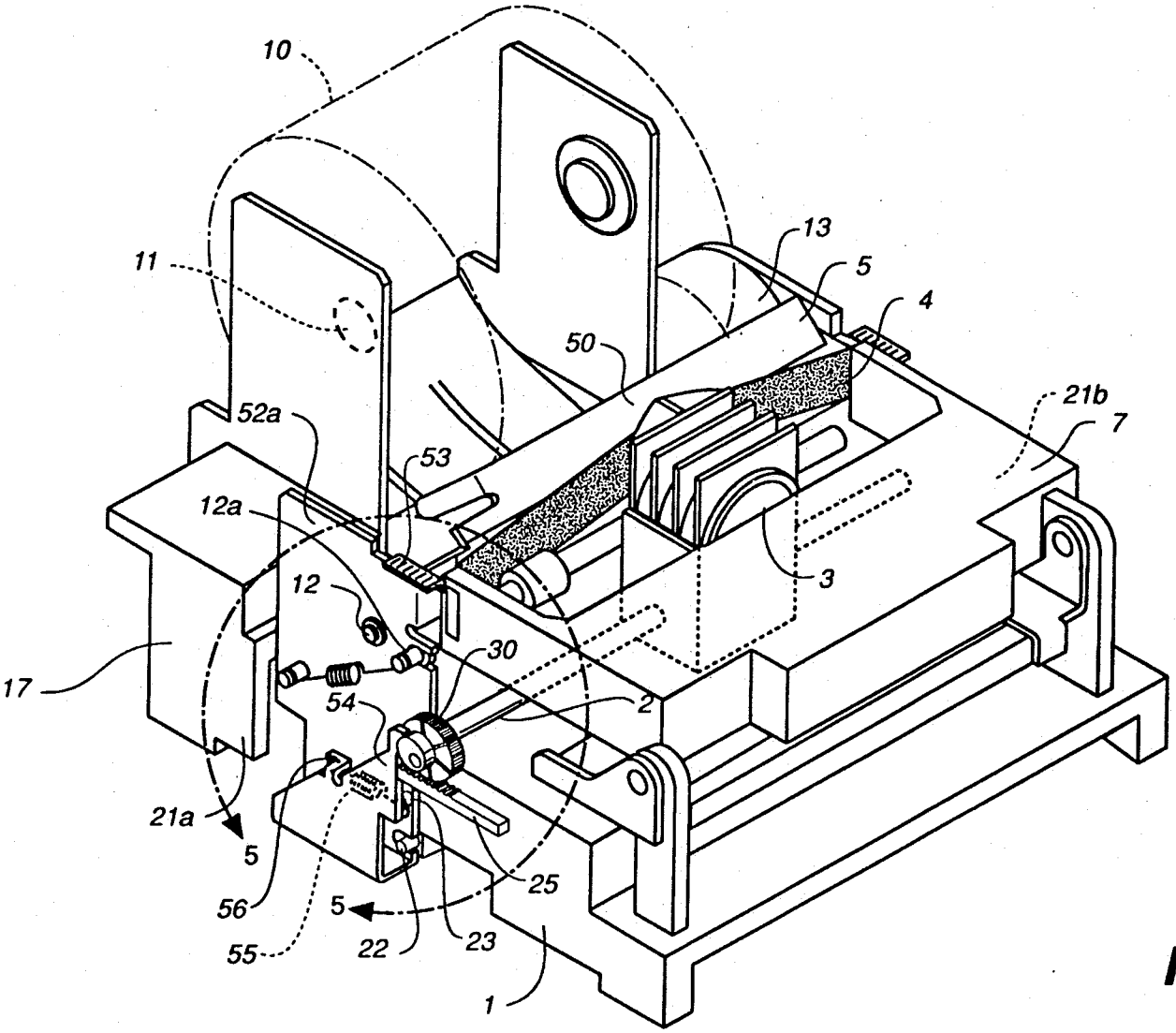
FIG. 1 illustrates a perspective view of one embodiment of a printer constructed and operating according to the principles of the present invention.
Figure 2:
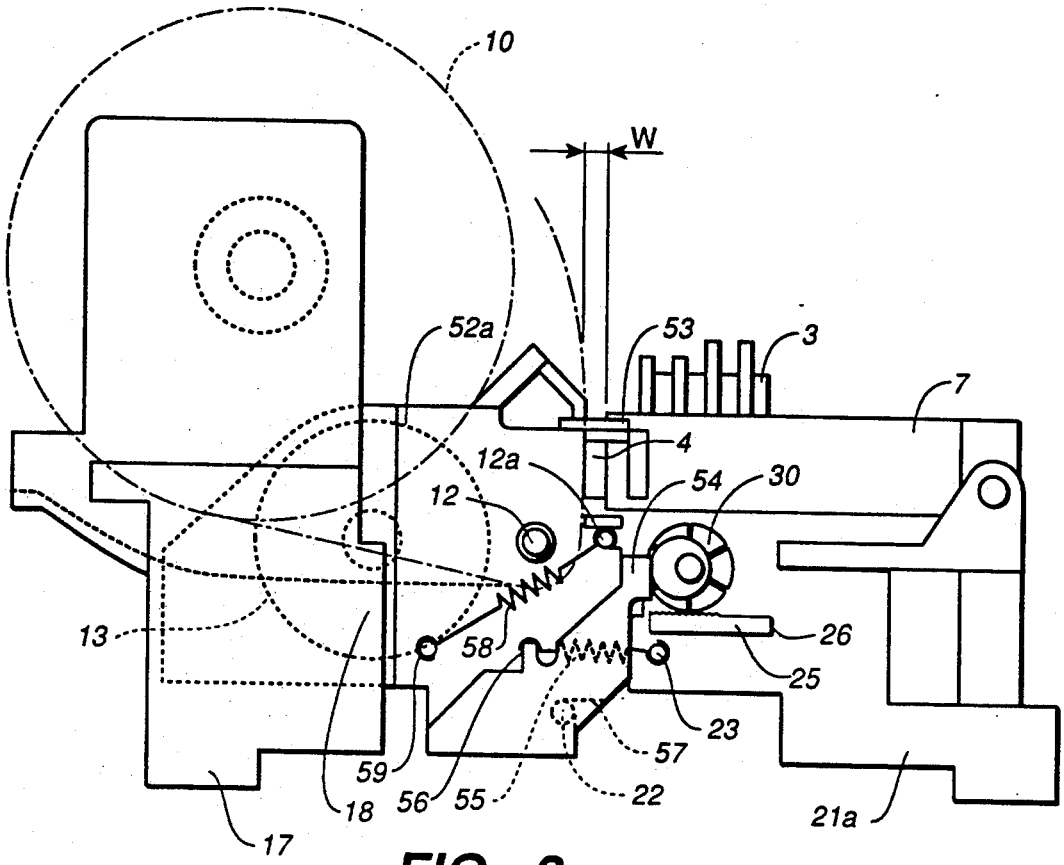
FIG. 2 illustrates a side view of the printer of FIG. 1.

The present invention is a frame structure and technique useful for manufacturing frames for printing devices with resin materials. The resulting frame is easily formed in a variety of configurations and profiles to meet the demands of specific applications and exhibits vibration and noise reduction characteristics. The frame structure employs a pivoting support frame to position a platen assembly adjacent to a fixed print head support frame and biasing and clearance elements that dynamically adjust for relative differences in thermal expansion between the two frames and their respective elements.

By using a floating platen support frame and positioning certain heavier components on that frame, vibration and noise are reduced.

One embodiment of the present invention is described below in reference to FIGS. 1 through 6 which illustrate several views of a frame structure for a printer constructed according to the invention. The printer illustrated in FIG. 1, comprises a base frame 1, a main guide shaft 2 mounted on base frame 1, a print head 3 mounted to move laterally along the main guide shaft, and a platen frame 5. Platen frame 5 is attached to base frame 1 so that it can be rotated about a pivot point in a direction substantially perpendicular to guide shaft 2, typically toward the main guide shaft. A print ribbon 4 is housed in a ribbon cassette 7 which is mounted on base frame 1. Ribbon 4 extends from the cassette and is disposed between print head 3 and a platen surface 50 on platen frame 5, and is used by print head 3 to generate output images on paper 10 or other medium.

Paper 10 is typically provided in the form of continuous or roll form paper which is mounted on a roll holder 11 and transferred to platen frame 5 and print head 3. However, those skilled in the art will recognize that other types of paper can be employed in connection with the present invention and this does not represent a limitation of the invention. Platen frame 5, surface 50, is used to support paper 10 in front of print head 3 and ink ribbon 4 which act in concert to produce a desired dot matrix pattern on the paper.

Figure 7:
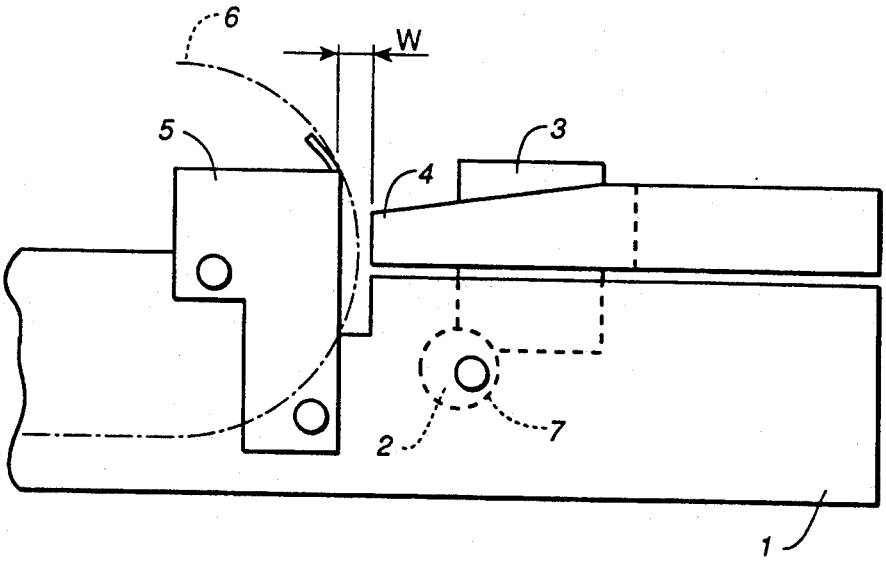
FIG. 7 (PRIOR ART)
FIG. 7 illustrates a side view of a prior art printer.
Figure 3:
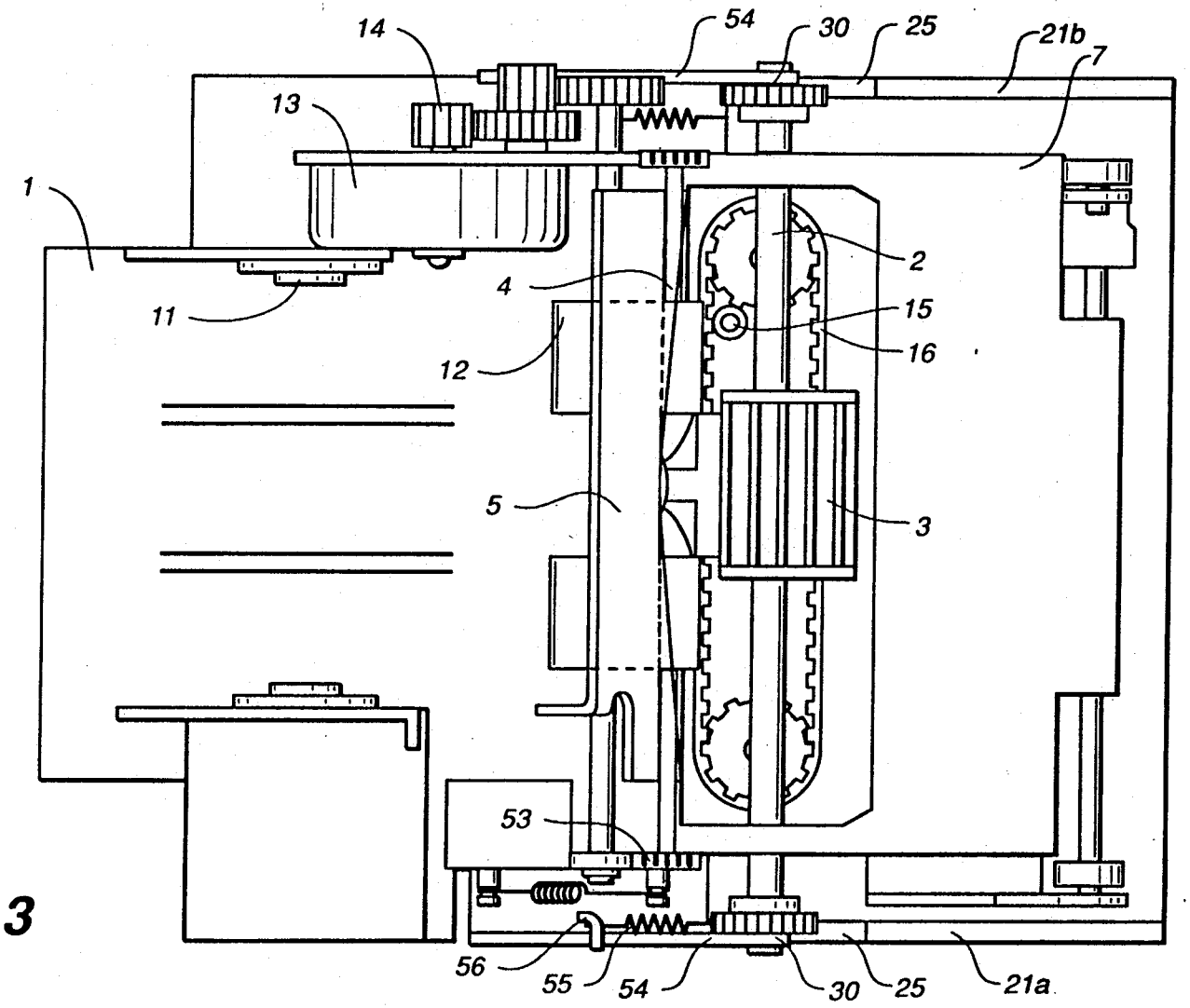
FIG. 3 illustrates a top view of the printer of FIG. 1.

In the preferred embodiment of FIGS. 1 through 5, frame 1 is typically manufactured from a resin material and molded as a single unit or unitary structure. A variety of resin materials, such as engineering plastic or polyacetal, can be used in association with known injection molding or other manufacturing techniques to form the desired frame shape. In addition, very thin metallic materials which can be easily molded into specialized shapes could also be employed as desired. Those skilled in the art will readily recognize that such materials fall within the teachings of the present invention and also understand the various manufacturing techniques and methods used to configure a structure from such materials.

Where the illustrated components in FIGS. 1 through 5 are generally the same as used in current printers in the art, they are identified by the same number as used in FIG. 7 and further explanation is omitted here for purposes of clarity.

In the embodiment of FIGS. 1 through 5, one end of paper on the paper roll mounted on holder 11 protrudes into the base frame where it is guided between platen frame 5 and ribbon 4 by a paper feeder or feed roller 12. Paper feeder 12 operates in cooperation with an auxiliary feeder or feed roller **12*a* to advance paper past print head 3, and is attached to platen frame 5 in a position reasonably parallel to main guide shaft 2. Paper feeder 12 is linked to, and driven by, a feed motor 13 using driving elements such as, but not limited to, a number of gears 14, all of which are mounted on platen frame 5 to create a single paper feeding unit. Motor 13 and feed rollers 12 and 12*a* also serve to increase the effective mass or weight of platen frame 5 which is otherwise very light. The increase in weight decreases the vibration and noise generated by platen frame 5 or platen surface 50** during use.

As paper 10 is guided between platen frame 5 and ribbon 4, the dot matrix pattern being printed by print head 3 is formed on the paper in response to character or other signals input from an outside source such as a host computer. Print head 13 is attached to main guide shaft 2 so that it slides along the shaft laterally across frame 1. Mounting elements such as, but not limited to, cylindrical bushings are useful for mounting head 3 on shaft 2, as is known in the art. Print head 3 is linked to a head drive motor 15 though a drive element such as a drive belt 16 which may be castellated or have ridges to assist in accurate positioning and improved traction. Head drive motor 15, acting through drive element 16, causes print head 3 to assume a variety of desired positions along main guide shaft 2 in forming characters, or graphics, on paper 10.

Figure 5:
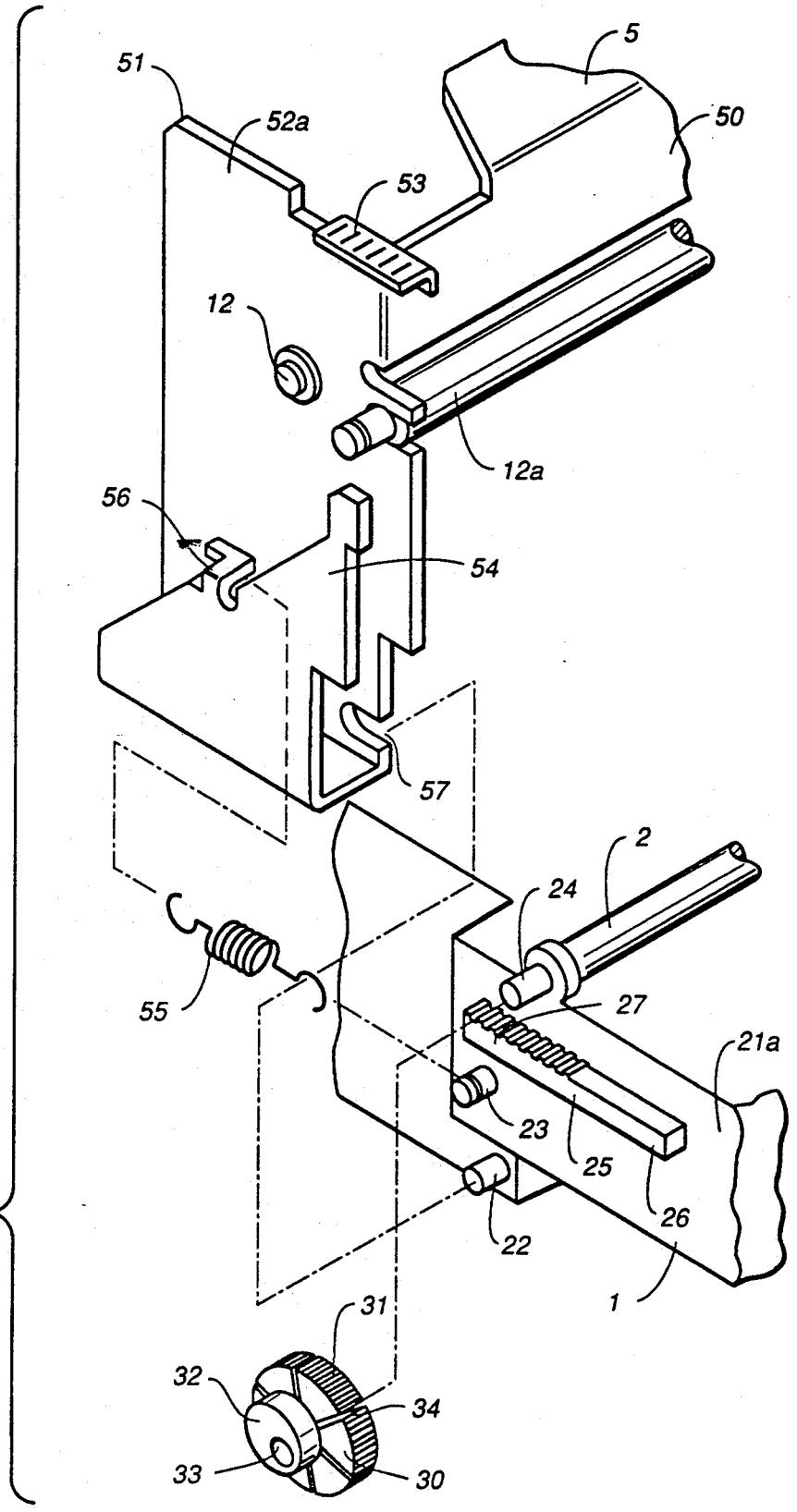
FIG. 5 illustrates an exploded view of a portion of the printer of FIG. 1, showing details of platen attachment components.

An important feature of this embodiment is a rotatable attachment structure or connection between platen frame 5 and base frame 1, which is shown in an exploded detail view in FIG. 5. As seen in the figures, platen frame 5 is generally manufactured as a plate-like member 51 which forms platen surface 50 and is manufactured from rigid metal material, such as, but not limited to, steel or aluminum, and shaped so that it guides paper 10 parallel to main guide shaft 2. Both ends of plate-like member 51 are bent at right angles to form attachment surfaces **52*a* and 52*b* and, thereby, facilitate attachment to base frame 1 using base frame side surfaces 21*a* and 21*b*, respectively. Plate-like member 51 typically comprises a rigid metal or similar material so that it has a surface (50) that readily withstands the long term surface loading resulting from print head 3, or print pins, periodically striking ribbon 4 against paper 10**, without deforming.

A clearance gauge 53 extends from plate-like member 51 in the direction of main guide shaft 2 and is generally formed on both attachment surfaces **52*a* and 52*b* adjacent to platen gap W. Clearance gauge 53 is constructed with graduation marks on at least one surface to allow ready determination of the separation distance between plate-like member 51, surface 50, and a front end of print head 3**.

As seen in FIG. 5, a protrusion or tab like element 56 is formed on outer surface **52*a*, or on clearance member 54 discussed below, which is used as an attachment point for one end of a rocker spring 55, which is used to help secure platen frame 5 to base frame 1. A notch and pin assembly is used to provide rotatable and floating attachment or connection of platen frame 5 to base frame 1. This is illustrated in FIG. 5 as a notch 57 formed in a lower portion of surface 52*a* (and 52*b*, not shown) and a protrusion in the form of a cylindrical pin 22 mounted in a corresponding position on side surface 21*a* (and 21*b*, not shown) of base frame 1. This notch and pin assembly facilitates attachment of platen frame 5, through surfaces 52*a* and 52*b*, to base frame 1 in a manner that allows it to rotate toward main guide 2 while moving parallel with respect to the sides, 21*a* and 21*b*, of base frame 1. At the same time, a protrusion or pin like element 23 is formed on surface 21*a* (and 21*b*) for attachment of the other end of rocker spring 55**.

Notch 57 is generally provided with a diameter slightly larger than that of protrusion 22 and with one open end. The configuration of slot 57 illustrated in FIGS. 1, 2, and 5, allows both rotation about protrusion 22 and slight parallel displacement relative to the protrusion and base frame 1. This structure provides a "floating" pivot joint for platen frame 5 so that it is not rigidly secured to base frame 1. This mounting technique decreases the transfer of noise and vibrations between platen frame 5 and base frame 1.

At the same time, if motor 13 is displaced from the center of gravity or from notch 57 and protrusion 22, by an appreciable distance, typically occupying an offset radial position between about 9 and 10 o'clock relative to notch 57, its weight is in effect leveraged and provides an increased resistance to spurious rotation of platen frame 5 which also reduces vibration.

Protrusions 56 and 23 can be formed using a variety of structures, including various tabs punched out of the material of, or pins attached to, frame 5 and can also be formed using alternatives such as holes into which the ends of spring 55 are inserted. Protrusion 23 is formed at a location generally opposite to protrusion 56 and toward the main guide shaft 2. In FIG. 5, paper feeders 12 and 12*a* are also shown positioned between attachment surfaces 52*a* and 52*b* across platen frame 5, or plate like member 51 with attachment ends extending from the attachment surfaces. In order to provide for balanced friction pressure loading and accommodate thickness variations in the paper, the end of feeder 12*a* is shown mounted in a slot. As seen in FIG. 1, a retention spring 58 is connected between the end of feeder 12*a* and a protrusion or pin 59 to secure feeder 12*a* in place.

The above attachment assembly and paper feed structure provide at least three advantages over the art. Firstly, the use of a guide slot or notch 57 for support allows, as stated, some degree of movement for the platen frame relative to the base frame. The non-rigid mounting and small amount of lateral freedom of movement effectively absorbs or fails to transfer vibrations in the platen frame to the base frame. That is, without an absolutely rigid attachment or highly constrained hinged joint, vibrations or high frequency components of motion of the platen frame are not transferred to the base frame through protrusion 22. This automatically provides less noise and vibration for the overall printer structure by not transferring vibrations and acoustical noise to the base frame and any housing or casing to which it is attached. At the same time, this allows the base frame to be very rigidly secured in place in a casing or housing without as much concern for acoustical isolation in its mounting, thus, simplifying construction.

Secondly, the support of the feed rollers and guides 12 and 12*a*, and the paper advance motor assembly on platen frame 5, increases the weight of the platen frame assembly. This added weight also tends to dampen out excessive vibrations and motion providing for quieter operation with regards to the platen frame and decreasing vibrations and noise which could be transferred to the rest of the printer. At the same time the increased weight of the platen frame assembly provides a more uniform motion of platen frame 5 about pins 22 with regards to base frame 1 which an extremely light frame may not otherwise provide.

Thirdly, the rotating joint between platen frame 5 and base frame 1 allows control over the platen gap so that variations in frame dimensions due to thermal loading can be automatically compensated for and the platen gap maintained constant.

The platen gap between the rotating platen frame and base frame 1 is made constant, or in the case of uneven thermal expansion between the two frames, self-compensating, by using at least one gap fixing means or clearance adjustment device disposed between the two frames. In a preferred embodiment, this clearance device is constructed using a clearance member and an elastic member, and takes advantage of the thermal expansion properties of the separate frames to automatically adjust the platen gap spacing whenever the frames change relative dimensions and positions. In addition, the new clearance device also accommodates various deformities or imperfections that might be encountered in the manufacture of plastic or resin type frames. Therefore, even if the base frame should become deformed due to thermal expansion, etc., during use, the platen gap between the platen frame and the print head is permanently maintained at a desired value by absorbing the amount of deformation.

The clearance device comprises two principle components or sections, a biasing element to draw platen frame 5 towards main guide shaft 2, and a clearance fixing element to establish the platen gap dimension in counteracting the force exerted by the biasing element. In a simple, form the invention comprises an elastic element which either biases platen 5 toward or away from base frame 1, and a rigid clearance element which correspondingly either pushes the two frames apart or together, respectively, against the force of the elastic element.

As seen from the above disclosure, in this embodiment, rocker spring 55 acts as the desired biasing element to draw platen frame 5 close to main guide shaft 2 as it rotates about pins or protrusions 22. In the alternative, the same gap control can be obtained by changing the attachment position of the rigid clearance element, discussed below, and using a compression type spring and motion.

The more rigid clearance element is formed as a two-part structure from a clearance member and a clearance adjustment member. As shown in FIGS. 1 and 5, a clearance member 54 is positioned on the outside of attachment surfaces 52*a* and 52*b*, i.e., on the outside of plate-like member 51, and is typically a roughly rectangular solid member that protrudes from the main body of plate-like member 51 and extends toward main guide shaft 2. In FIG. 1, clearance member 54 is formed by bending part of the material for plate like member 51 around to extend parallel to surface 52*a*. However, those skilled in the art will readily understand that clearance member 54 can be formed as a separate element and attached to surface 52*a* or 52*b* using a variety of techniques.

Clearance member 54 is used to establish a basic separation distance between platen frame 5 and guide shaft 2, and, therefore, print head 3. The specific shape of clearance member 54 is not limited to that illustrated in FIGS. 1, 2, 3, or 5, and other shapes can be employed provided they provide an abutting surface to interact with the clearance adjustment member, discussed below, to regulate the platen gap width. That is, a less rectangular shape may be employed including circular and triangular projections having an abutting surface.

As also shown in FIGS. 1 and 5, at least one clearance adjustment member 30 is mounted on base frame 1 in a position that allows interaction with the protruding end of clearance member 54. In the preferred embodiment, clearance adjustment member 30 is attached to end 24*a*, and/or 24*b* as desired, of main guide shaft 2 where it extends outside of side surfaces 21*a* and 21*b* of base frame 1. In this embodiment clearance adjustment member 30 comprises an anchor disc 31 with grooves formed on its outer circumference and on which is secured an adjustment disc 32, typically having a smaller diameter. An attachment passage or hole 33 is formed centrally in each of the discs and used to attach the discs to ends 24*a*, or 24*b*, of main guide shaft 2. The attachment hole in disc 32 is centrally located but positioned eccentric with respect to the radial center so that the circumference of disc 32 has an eccentric motion when rotated about the axis of main guide shaft 2.

As seen in FIGS. 1 and 5, an anchor member 25 protrudes or extends from each side surface 21*a* and 21*b* of base frame 1 adjacent to each adjustment member 30 anchor disc 31. An end 26 of anchor member 25 is rigidly fixed to side surface 21*a*, or 21*b*, of base frame 1, with the other end, 27, being free standing. Anchor member 25 is secured in place using a variety of known techniques and could be formed in part as part of base frame 1 in some embodiments.

Free end 27 of anchor member 25 has a series of substantially parallel grooves or notches formed along a surface adjacent to anchor disc 31. The clearance adjustment members 30 are attached so that the grooved outside circumference of anchor disc 31 presses against grooved end 27 so that the grooves on the two surfaces interleave or mesh with each other. Therefore, each anchor member 25 serves as a generally rectangular solid ratchet gear having grooves or teeth in contact with matching grooves or teeth on an anchor disc 31, thus, anchoring clearance adjustment member 30 at various prescribed angles of rotation or radial positions.

Due to the interconnection of surfaces through the mating of gear teeth, rotating anchor disc 31 causes a sound to be generated by the deflection or vibration of free end 27 of anchor member 25, typically in the form of "clicking". This makes it possible to confirm the angular position, or change in position, of adjustment plate or disc 32 by counting the number of "clicks" heard during disc 31 rotation. At the same time, if anchor discs and members having the same teeth pitch are used on both ends of main guide shaft 2, adjusting each end the same number of "clicks", in the same direction of rotation, causes the same amount of movement either away from or towards platen frame 5. Provided both ends of main guide shaft 2 are initially set with the same platen gap, this technique provides a simple and highly efficient means of providing a uniform platen gap adjustment or readjustment along main guide shaft 2 during subsequent printer use. Also, provided the pitch of the grooves is uniform or constant, a printer operator can easily adjust printing image quality by resetting anchor disc position a certain number of clicks after viewing a test print output.

As shown in the detail of FIG. 5, a series of notches or larger grooves 34 are formed in anchor disc 31 at intervals along the circumference which form depressions for interacting with a flat or thin planar adjustment tool such as a small screwdriver. This allows easy adjustment of the angular position of anchor disc 31 by a printer user.

Using the structure disclosed above, first platen frame 5 is attached to the base frame 1 so that attachment notch 57 on platen frame 5 engages protrusions 22 on base frame 1. Platen frame 5 is attached to base frame 1 in a way that allows rotation and slight parallel displacement. Platen frame 5 is pulled toward main guide shaft 2 by rocker spring 55. Clearance member 54, fixed to platen frame 5, is formed so that one surface or end comes in contact with adjustment disc 32 of clearance adjustment member 30. Therefore, a constant distance between platen frame 5 and main guide shaft 2 is achieved by rocker spring 55 pressing clearance member 54 against adjustment disc 32.

As stated above, in the preferred embodiment of the invention, base frame 1 is manufactured from a plastic or resinous material to gain the previously discussed advantages of cost, noise reduction, flexibility, etc. However, since platen frame 5 is typically manufactured using metal or a material more rigid, and of differing composition, than base frame 1, the coefficients of thermal expansion are different.

When the temperature of base frame 1 (here resin) and platen frame 5 (here metal) each increase due to heat generated in or around the printer and each frame undergoes thermal expansion, the distance (platen gap) between main guide shaft 2 and protrusion 22, to which platen frame 5 is attached, increases. However, since platen frame 5 is pulled toward main guide shaft 2 by rocker spring 55 so that clearance member 54 presses against adjustment disc 32, platen frame 5 either rotates on protrusion 22 or undergoes parallel displacement along notch 57, thus, maintaining a constant gap between platen frame 5 and main guide shaft 2. When the temperature drops and base frame 1 contracts, however, platen frame 5 is pushed away from main guide shaft 2 by the clearance member 54 pressing against adjustment disc 32, and the gap between platen frame 5 and main guide shaft 2 is kept constant.

At the same time, where clearance member 54 and clearance adjustment member 30 are manufactured from materials having the same or similar coefficients of expansion as the respective frames they are mounted on, they add to the automatic regulation of platen gap W. If either frame undergoes thermal expansion that would otherwise move platen surface 50 or main guide shaft 2 toward each other, through linear expansion of sides 52*a* and 52*b* or sides 21*a* and 21*b*, then the mating or abutting edges of the adjustment members undergo a similar expansion and push these elements apart. That is, the contact surface of clearance member 54 is shifted toward clearance adjustment member 30 by thermal expansion at the same rate platen surface 50 is moved toward main guide shaft 2. Since clearance member 54 is already in contact with the surface of clearance adjustment member 30, it cannot physically move any closer. Instead, the thermal expansion pushes the rest of platen frame 5 away from main guide shaft 2, rotating about pins 22. Platen frame 5 is moved away from main guide shaft 2 by the same amount platen surface 50 is moved toward main guide shaft 2, resulting in no change in the platen gap. The thermal expansion of base frame 1 and clearance adjustment member 30 interact in the same manner to compensate for movement of main guide shaft 2 toward platen frame 5.

In this manner, whether base frame 1 undergoes thermal expansion or thermal contraction, the gap between platen frame 5 and main guide shaft 2 is maintained at a desired setting by rocker spring 55 and clearance member 54. That is, thermal expansion or contraction, which can otherwise present problems in a resin based frame structure, has no effect, and platen gap W, between platen surface 50 and print head 3, is maintained constant, making clear high quality printing possible.

Furthermore, using eccentric clearance adjustment member 30 as disclosed, general adjustment and readjustment of platen gap W is possible. Therefore, even if base frame 1 is deformed either as a result of a manufacturing or production defect, or as a result of installation in a printer assembly, that deformation can be easily corrected. As an example, resin based frames may have imperfections or deformations resulting from molding processes, or these and thin metal type base frames can be deformed when bolted into a printer support housing. Either type of deformation can be accommodated using the present clearance adjustment member 30.

It is also possible, of course, to use clearance adjustment member 30 to adjust platen gap W according to the thickness of paper 10. In this case, if clearance adjustment members are disposed on both ends of main guide shaft 2, platen gap W is adjusted by moving both clearance adjustment members at the same time, and by the same amount. The installation of clearance gauge 53 in the frame structure of this embodiment also facilitates easy measurement of the platen gap in this, or other, case.

In the alternative, platen gap W can also be adjusted by attaching main guide shaft 2 eccentrically to base frame 1, as previously explained in reference to FIG. 7. In this case, the magnitude by which the platen gap is increased or decreased by rotating main guide shaft 2 is constant over the whole region in which print head 3 moves to print. However, an adjustment method such as taught by the present invention which uses two clearance adjustment members 30, one disposed on each end of main guide shaft 2 to adjust gap W at each end independently, is better suited to printers that use a resin type frame, which is susceptible to deformation during molding and other types of non-uniform deformation because platen gap W can be made constant in the whole printing region. That is, a deformation in base frame 1 that is non-uniform between the two sides, different from each other, causes a non-uniform variation in platen gap W from side to side which can be independently compensated. In addition, in this case, the manufacturing precision required for the clearance and clearance adjustment members can be eased because a certain range of difference in the size of each member disposed on each end of the main guide shaft is compensated by using this adjustment method. Therefore, the manufacturing cost of this type of printer frame can be appropriately decreased.

As described above, clearance member 54 and rocker spring 55 are used to maintain a constant distance between platen frame 5 or platen surface 50 and the front end of print head 3, thus making it possible to keep platen gap constant. By using a gap fixing means that maintains a constant distance between the main guide shaft and the platen frame, a printer can be configured that uses a base frame formed from resin or even a thin metallic material.

Using resin material, frames with a variety of complex shapes can be easily obtained, by extrusion molding and other techniques, thus, facilitating realization of a compact, lightweight printer. Therefore, printers with shapes that meet the demands of various devices can be produced, and even frames molded in a single unit can be realized with a flexible structure, a rigid structure, or with stoppers, guides, etc. A single unit can be manufactured that combines paper holder 11, a frame support 17 for the base frame, paper feed section 18 for guiding paper toward the platen using a bottom surface of the base frame as a reference, protrusions 22 and 23, and anchor member 25. Therefore, it is possible to reduce the number of parts that otherwise make up a printer, shorten production periods, and realize low cost, highly reliable printers.

It is also possible to select a color for the resin from among a variety of colors, and by selecting transparent resin, otherwise complicated mounting operations can be simplified. Furthermore, unlike metal frames, these frames will not rust and offer long-term reliability.

Also, since frames made from resin allow for a low-rigidity, flexible structure, they are ideal for printers that must satisfy demands for prevention of sound and vibration, and reliability because the elasticity of resin is expected to suppress sound and vibration and absorb noise generated during printing. In addition to absorbing internal vibration, external vibration can also be absorbed, thus improving anti-vibration performance during printing. Therefore, by molding frames from resin, various environmental measures such as vibration and noise prevention can be implemented, and low cost printers can be quickly realized that can flexibly accommodate demands for various devices.

Figure 4:
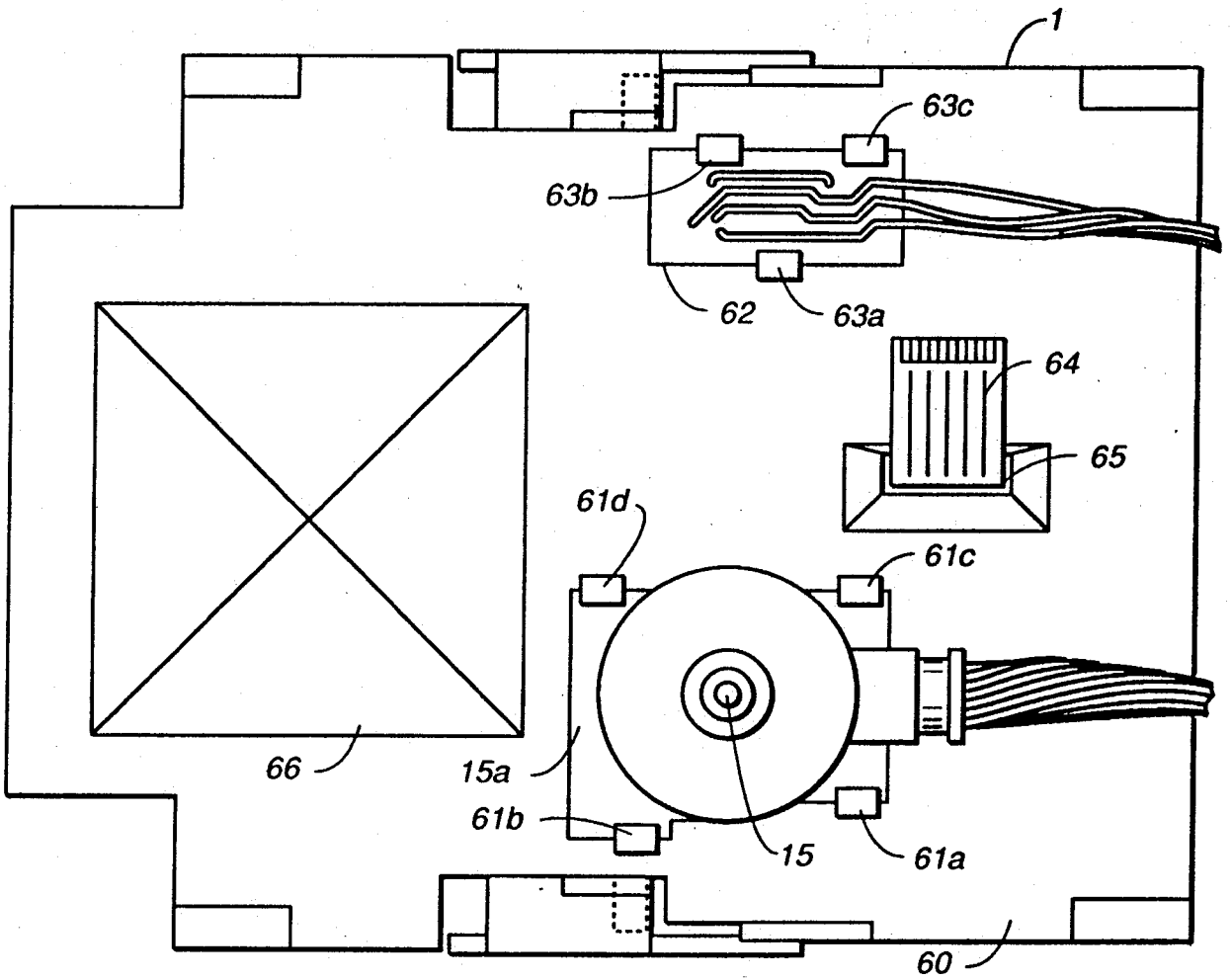
FIG. 4 illustrates a rear view of the printer of FIG. 1.

As shown in the bottom view of FIG. 4, there are four attachment claws **61*a*–61*d* formed on a bottom surface 60 of base frame 1, which are used for attaching head drive motor 15. Motor 15 is typically attached to base frame 1 by inserting a motor mounting frame 15*a* in claws 61*a*–61*d* from the side. Claws 61*a*–61*d* are formed as a unit with resin base frame 1, and it is possible to easily mold the claws in a variety of shapes depending on the motor part to be attached. Further, as with motor 15, it is also possible to secure printed circuit board 62 to base frame 1 using a series of attachment claws 63*a*–63*c***.

Since resin base frame 1 can be easily molded in complex shapes, a through-hole 65 with tapered edges can be formed for passage of printed wiring 64 from print head 3 through base frame 1. By forming through-hole 65 with tapered sides, broken wires due to bending of printed wiring 64 at right angles are prevented. In FIG. 4, a space 66 is shown below holder 17 of base frame 1 where a printed circuit board can be mounted for controlling the printer.

A resin base frame can also have a partially flexible structure on which the platen frame is secured, that absorbs displacement of the platen frame as it follows changes in relative position of the main guide shaft, in response to the gap fixing elements. However, it is desirable to employ a rocker or rotating platen frame attached to the base frame that can rotate or undergo parallel displacement in a direction that absorbs thermal expansion and distortion of the base frame, i.e., allows the platen frame to follow displacement of the main guide shaft, as in the above example. By employing a rocker type of platen frame, the base frame is not deformed and material fatigue caused by internal stress is prevented even when the platen frame moves to follow the main guide shaft. Also, deformation of the platen frame is prevented since no stress is generated in the platen frame itself. Therefore, clear printing can be achieved without special considerations such as reinforcement of the base frame and platen frame structures.

Several elements can be alternatively employed for a gap fixing means or clearance device, such as fixing the distance between the main guide shaft and the platen frame by supporting the platen frame from the main guide shaft with a rigid member. However, since the platen frame must also support the paper, which receives pressure from the print head during printing, as well as the built in paper feed mechanism, its weight is relatively large, and supporting this weight in addition to the print head on the main guide shaft would require an excessively strong base frame and main guide shaft.

Therefore, it is more desirable to employ a means that comprises a rigid clearance member to regulate the gap between the main guide shaft and the platen frame, and an elastic member disposed between the base and platen frames to keep the platen gap constant, while lessening the weight on the main guide shaft. By using this gap fixing configuration, the pressure accompanying the elastic force of the elastic member constitutes the only added pressure on the main guide shaft, because the weight of the platen frame and the load accompanying thermal deformation of the base frame need not be supported by the main guide shaft. Distributing load in this manner makes it possible to optimize the structures of the base frame, platen frame, and main guide shaft.

In this embodiment, a gap clearance device or fixing means is formed at both ends of main guide shaft 2, but depending on the size of the printer, use conditions, etc., it need only be formed at one end of the main guide shaft. The clearance device can be configured using any member that regulates the gap between the main guide shaft and the platen frame, and as long as a constant platen gap is maintained, clearance members can be attached so that they oppose the direction of elasticity of the elastic member. Various element configurations can be used to realize the clearance and elastic members. Examples of such variations are presented in construction model form in FIGS. 6A and 6B.

Figure 6A:
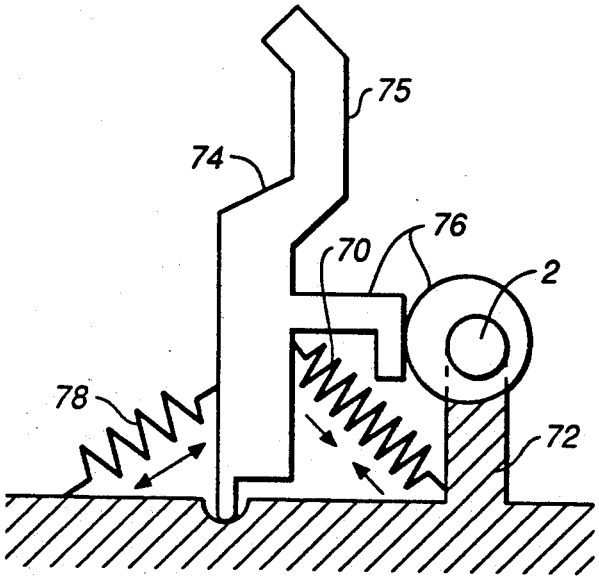
FIGS. 6A and 6B illustrate alternative configurations for clearance members employed in the printer of FIG. 1.

In the embodiment of FIG. 6A, an elastic member 70 is secured between a portion of a base frame 72 and a platen support frame 74. The elasticity or elastic force exerted by elastic member 70 is exhibited as a "pulling" force, such as in the case of a spring, between the two frames as shown by associated directional force arrows. A clearance member 76 is disposed in a position between the two frames to oppose this pulling force. Another elastic member 78 is also shown in FIG. 6A, but is mounted to exert an elastic force as a "pushing" force, such as in a compression spring, which is illustrated by associated force arrows. Clearance member 76 also effectively opposes this force.

In FIG. 6A, elastic member 70 is positioned on base frame 72 in the same general direction as main guide shaft 2, on which is disposed clearance member 76, with respect to platen frame 74, while elastic member 78 is positioned on base frame 72 in the opposite direction from main guide shaft 2 with respect to platen frame 74. It is easily seen from FIG. 6A that the clearance member can comprise many elements that regulate the gap between main guide shaft 2 and platen frame 74, platen 75, and as long as it maintains a constant gap, it can be attached so that it opposes the direction of elasticity of the elastic member.

Figure 6B:
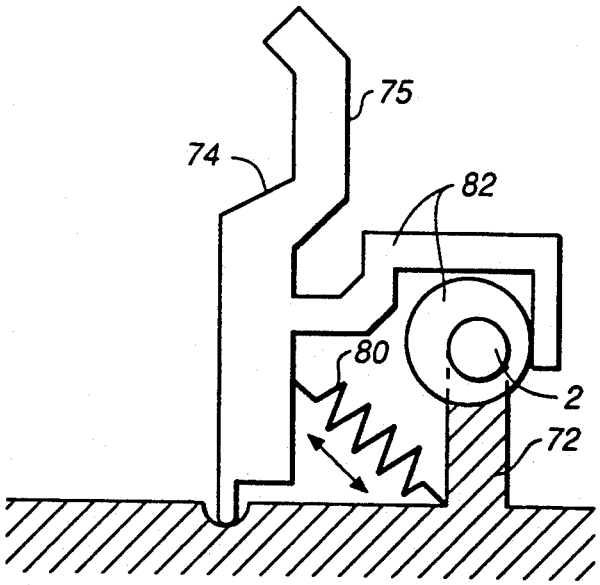

In the embodiment of FIG. 6B, a compression type elastic member 80 is disposed on the same side of base frame 72 as elastic member 70 as was previously shown in FIG. 6A, and extends in the same general direction as main guide shaft 2. However, since elastic member 80 exerts a "pushing" type force, it operates to move platen frame 74, surface 75, and main shaft 2 apart, thus requiring a different configuration for the clearance member. Therefore, a clearance member 82 is used which opposes the force exerted by elastic member 80 by interacting with the opposite side of main guide shaft 2. Therefore, it is readily apparent that a variety of physical configurations can be used for the clearance members previously described as long as they are appropriately configured to oppose the forces of the elastic member being employed.

Further, the clearance adjustment member is not limited to the use of a disc-shaped member with an axis eccentric to the center of the clearance adjustment member. The clearance adjustment member also need not be attached to the ends of the main guide shaft and rotated around an eccentric axis with respect to the shaft. The same kind of clearance adjustment member can also be attached directly to the platen frame where desired or more convenient. A cam or other device can also be used in place of the eccentric disc-shaped member.

It is also apparent that other types of frames can benefit from the application of the present invention besides resin based frames. That is, thin metal frame which lack sufficient rigidity for many applications or which have different compositions than the associated platen frame can also be used in conjunction with the present invention to great advantage.

A printing device has been described above that uses a gap fixing element or means generally configured from one or more clearance members and an elastic member. Using this configuration, even if the base frame is deformed due to thermal expansion, etc., experienced during use, the platen gap between the platen frame and the print head is permanently maintained by absorbing the amount of any deformation, and clear, high quality printing is achieved. Therefore, it is possible to use a frame made from resin, which has a large thermal expansion coefficient, as a base frame.

Resin frames have a number of advantages such as superior noise-proofing and vibration-proofing effects and the ability to be formed as a single base frame unit for printers, which can have complex shapes, and they can be used to realize printers that satisfy various specifications, such as compactness, light weight and low cost, which have come into demand in recent years.

In addition, the application of a floating type of frame structure and the use of the feed motor and other components to increase the effective mass, or weight, of the platen frame also decreases the transfer of vibrations and noise from the platen frame.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

What is claimed is:

1. A printing device using a print head that moves on a main guide shaft to print on an output medium positioned near the guide shaft on a platen, comprising:

a base frame of easily formable and relatively light weight material;

a main guide shaft attached to the base frame so as to guide a print head across said frame;

a platen frame attached to the base frame with a floating joint so that it supports a platen substantially parallel to the main guide shaft so as to position output medium adjacent to the print head for printing; and gap fixing means disposed between said base and platen frames for maintaining a constant value for a predetermined, adjustable, separation distance, during printing, between the main guide shaft and the platen frame under various operating conditions, comprising:

a mating surface, means to provide continuous abutting contact of the gap fixing means with said mating surface and to regulate the gap including a rigid clearance member formed on one of said frames and having an abutment surface that extends toward the other of said frames to interact therewith, and an elastic member disposed between and connected to both the base frame and the platen frame to positively bias said frames toward each other.

2. The printing device of claim 1 wherein the platen frame comprises a rocking platen attached to the base frame so as to rotate in a direction substantially perpendicular to the main guide shaft in response to the gap fixing means.

3. The printing device of claim 2 further comprising at least a feed motor and paper feed rollers secured to said platen frame.

4. The printing device of claim 3 wherein said motor is displaced from a vertical line extending upward from any pivot joint for said platen frame and is positioned away from said main guide shaft.

5. The printing device of claim 1 wherein said floating joint comprises a slot on said platen frame coupled to a pivot element on said base frame so as to allow motion in a direction substantially perpendicular to the main guide shaft in response to the gap fixing means.

6. The printing device of claim 1, wherein said base frame comprises first and second substantially parallel frame members, wherein a first end of said main guide shaft is attached to said first frame member and a second end of said is attached to said second frame member, wherein said gap fixing means comprises a first adjustment member disposed on said first frame member and in operative communication with said first end of said main guide shaft and a second adjustment member disposed on said second frame member and in operative communication with said second end of said main guide shaft.

7. The printing device of claim 1 wherein said rigid clearance member comprises:

a clearance body having an abutment surface extending from said platen frame toward said main guide shaft;

an adjustment member disposed on said base frame and having substantially continuous surface contact with said clearance body abutment surface, said adjustment member having an adjustable position that regulates the gap between the main guide shaft and the platen frame; and anchor means coupled to said adjustment member for securing said member in any of a plurality of desired positions.

8. The printing device of claim 7 wherein said adjustment member is disposed on at least one end of the main guide shaft.

9. The printing device of claim 7 wherein said clearance adjustment member is a disk-shaped member and is supported by either the end of the main guide shaft or the platen frame so as to rotatable about an axis that is eccentric with respect to the clearance adjustment member.

10. The printing device of claim 9 further comprising anchor means coupled to said disk-shaped member for securing said member in predetermined angle of rotation.

11. The printing device of claim 10 wherein said anchor means comprises:

an anchor disk secured to the disk-shaped member that has a grooved or teethed surface of predetermined pitch; and an anchor gear mounted adjacent to the anchor disk which has a surface with a like groove or teeth pitch which is coupled to said anchor disk surface.

12. The printing device of claim 1 wherein the elastic member comprises a spring.

13. The printing device of claim 1 wherein at least said base frame comprises a resin material.

14. The printing device of claim 13 wherein said resin material has a large coefficient of thermal expansion.

15. The printing device of claim 13 wherein said resin frame has at least one or more structural deformations.

16. The printing device of claim 1 further comprising a clearance gauge disposed between said platen and base frames adjacent a platen gap for measuring the gap between the platen frame and print head.

17. The printing device of claim 1 further comprising a wherein said base frame is fixed substantially rigidly to a printer casing.

18. The printing device of claim 1 wherein the platen frame comprises a substantially rigid metallic material.

19. The printing device of claim 1 wherein said rigid clearance member comprises:

a clearance body having an abutment surface extending from said platen frame toward said main guide shaft;

an adjustment member disposed on said base frame and having surface substantially continuous contact with said clearance body abutment surface, said adjustment member having an adjustable position that regulates the gap between the main guide shaft and the platen frame;

an anchor body rotatably secured to an outer surface of the disk-shaped member, having a grooved or teethed peripheral surface of predetermined pitch; and an anchor gear mounted adjacent to the anchor body which has a mating teethed surface which is coupled to said anchor body.

20. The printing device of claim 19 wherein said clearance body comprises an elongated generally U shaped rectangular projection extending outward from said platen frame toward said base frame and around said adjustment member and having a substantially planar abutment surface that contacts a side of said adjustment member positioned away from said base frame.

21. The printing device of claim 20 wherein said an elastic member comprises at least one coil spring having one end connected to said base frame and a second end connected to said platen frame and configured to operate in a compressive mode to bias said frames toward each other.

22. The printing device of claim 12 wherein said spring comprises at least a first coil type spring having one end connected to said base frame and a second end connected to said platen frame and configured to bias said frames toward each other.

23. The printing device of claim 22 wherein said elastic member further comprises at least a second coil spring connected between said base frame and said platen frame so as to bias said frames in a direction substantially opposite to that of said first spring.

24. The printing device of claim 7 wherein said anchor means is configured be printer user resettable to new desired positions.

25. The printing device of claim 7 wherein said rigid clearance member comprises a rectilinear body having planar abutment surface on one end that extends from said platen frame toward said main guide shaft, but does not extend beyond said guide shaft.

* * * * *

UNITED STATES PATENT AND TRADEMARK OFFICE

CERTIFICATE OF CORRECTION

PATENT NO. : 5,322,377

DATED : June 21, 1994

INVENTOR(S) : Naoki Asai

It is certified that error appears in the above-identified patent and that said Letters Patent is hereby corrected as shown below:

Column 16 Claim 19, Line 28, after "having" delete "surface".

Claim 19, Line 28, after "continuous" add --surface--.

Claim 21, Line 46, after "said" delete "an".

Claim 24, Line 62, change "be printer" to --to be--.

Signed and Sealed this

Twenty-ninth Day of November, 1994

*Attest:*

Bruce Lehman

BRUCE LEHMAN

*Attesting Officer*

*Commissioner of Patents and Trademarks*